US005423167A

United States Patent [19]

Stahlecker et al.

[11] Patent Number: 5,423,167

[45] Date of Patent: Jun. 13, 1995

[54] SPINNING MACHINE WITH INCLINED DRIVEN SLIVER TRANSPORT BELT

[76] Inventors: Fritz Stahlecker, Josef-Neidhart-Strasse 18, 7347 Bad Überkingen; Hans Stahlecker, Haldenstrasse 20, 7334 Süssen, both of Germany

[21] Appl. No.: 207,237

[22] Filed: Feb. 22, 1994

Related U.S. Application Data

[63] Continuation of Ser. No. 871,313, Apr. 20, 1992, abandoned.

[30] Foreign Application Priority Data

Jul. 16, 1991 [DE] Germany ..... 41 23 453.7

[51] Int. Cl.[6] ..... D01H 13/04

[52] U.S. Cl. ..... 57/90; 57/352

[58] Field of Search ..... 57/90, 91, 315, 352; 19/150, 153, 157, 159 R, 144, 145.5; 198/841, 823

[56] References Cited

U.S. PATENT DOCUMENTS

| | | | |
|---|---|---|---|
| 2,584,288 | 2/1952 | Przybylski | 198/841 |
| 3,312,050 | 4/1967 | Noguera | 57/90 |
| 3,564,829 | 2/1971 | Tsuzuki | 57/90 |
| 3,724,646 | 4/1973 | Kornylak | 198/841 |
| 3,728,760 | 4/1973 | Johns . | |
| 4,078,369 | 3/1978 | Brandis | 57/90 X |
| 4,171,044 | 10/1979 | Rossio | 198/841 |
| 5,319,913 | 6/1994 | Stahlecker et al. | 57/90 |

FOREIGN PATENT DOCUMENTS

| | | | |
|---|---|---|---|
| 2615911 | 10/1976 | Germany | 198/841 |
| 1015780 | 1/1966 | United Kingdom . | |

*Primary Examiner*—Clifford D. Crowder
*Assistant Examiner*—Larry D. Worrell, Jr.
*Attorney, Agent, or Firm*—Evenson McKeown Edwards & Lenahan

[57] ABSTRACT

In the case of a spinning machine comprising several spinning stations for the spinning of slivers fed in cans into yarns, drivable transport belts are provided which transport the slivers between the cans and the spinning stations. When bridging differences in height with respect to the horizontal line, the transport belts are arranged in such a sloped manner that the slivers rest on the transport belts because of their own weight. Lateral coverings against damaging air flows are preferably assigned to the transport belts.

15 Claims, 4 Drawing Sheets

SPINNING MACHINE WITH INCLINED DRIVEN SLIVER TRANSPORT BELT

This application is a continuation of application Ser. No. 07/871,313, filed on Apr. 20,1992 now abandoned.

BACKGROUND AND SUMMARY OF THE INVENTION

This invention relates to a spinning machine comprising several spinning stations for the spinning of slivers fed in cans into yarns and comprising drivable transport belts for conveying the slivers between the cans and the spinning stations.

In the case of a spinning machine of this type (British Patent Document GB 10 15 780), which is constructed as a ring spinning machine, a second transport belt is assigned to each transport belt. Thus, transport belt pairs are formed which each receive one sliver between the belts and transport it. The slivers are withdrawn from the cans by means of rollers arranged above them, are transported vertically downward, are conveyed below the floor to the spinning machine and are guided from there diagonally upward approximately to the machine center and farther to the drafting units. Ring spinning machines of this type have not been accepted in practice. The expenditures for the synchronous drive of the two transport belts, which have to be deflected frequently, are very high.

It is an object of the invention to improve a spinning machine of the initially mentioned type with respect to the transport belts.

This object is achieved in that the transport belts, when bridging differences in height, are arranged with respect to the horizontal line in such a sloped manner that the slivers rest on the transport belts because of their own weight.

When vertical transport paths are avoided and the slope of the transport belt is not made to be excessive, no additional devices are required which press the sliver to be transported against the pertaining transport belt. This is possible particularly when the space requirement for the setting-up of the cans is not too important.

In the case of a corresponding selection of the angle of slope, fine slivers, thus slivers of sizes from Nm 0.3 to 0.8, may also be transported by means of the transport belt without any risk of faulty drafts during the transport. It is therefore possible to do without the machine, specifically the flyer, which is normally connected in front of the ring spinning machine. Furthermore, such fine slivers make it possible to obtain higher yarn qualities than previously possible. In addition, these fine slivers permit the use of three-cylinder drafting units which are generally customary without the need to carry out significant constructive changes on the three-cylinder drafting units.

The expenditures may be further reduced when the width of the transport belts is designed for several slivers arranged next to one another. By means of relatively wide transport belts, it is possible to jointly transport per transport belt, for example, eight or sixteen slivers.

Problems occur mainly with the respective outer slivers since, because of the always existing air movements, there is the danger that the slivers may be deflected laterally. The danger of the lateral deflections exists particularly because the slivers adhere to the pertaining transport belt virtually only because of their own weight. In a further development of the invention, it is therefore provided that the slivers are protected from laterally leaving the transport belts.

This type of a protection can be achieved by means of different further developments:

For example, it is possible to leave a larger safety distance between the slivers and the edges of the transport belts. The slivers are therefore advantageously constructed to be so wide that such a large distance will still exist from the edge of the transport belt that lateral movements do not result in the slivers falling off the transport belts.

In a particularly advantageous development, it may be provided that at least partially lateral deflections are assigned to the transport belts. The transport belts are therefore virtually embedded in a protective covering which keeps disturbing air movements away from the slivers so that the danger of lateral deflections of the slivers is reduced. In addition, the coverings may provide a centering of the slivers on the pertaining transport belt.

In the case of another development of the invention, a protection against damaging lateral air movements as well as a centering of the slivers on the transport belt can be achieved by the fact that the transport belts have a trough-shaped cross-section at least on part of their transport path.

Other objects, advantages and novel features of the present invention will become apparent from the following detailed description of the invention when considered in conjunction with the accompanying drawings.

DETAILED DESCRIPTION OF THE DRAWINGS

Figure 1:
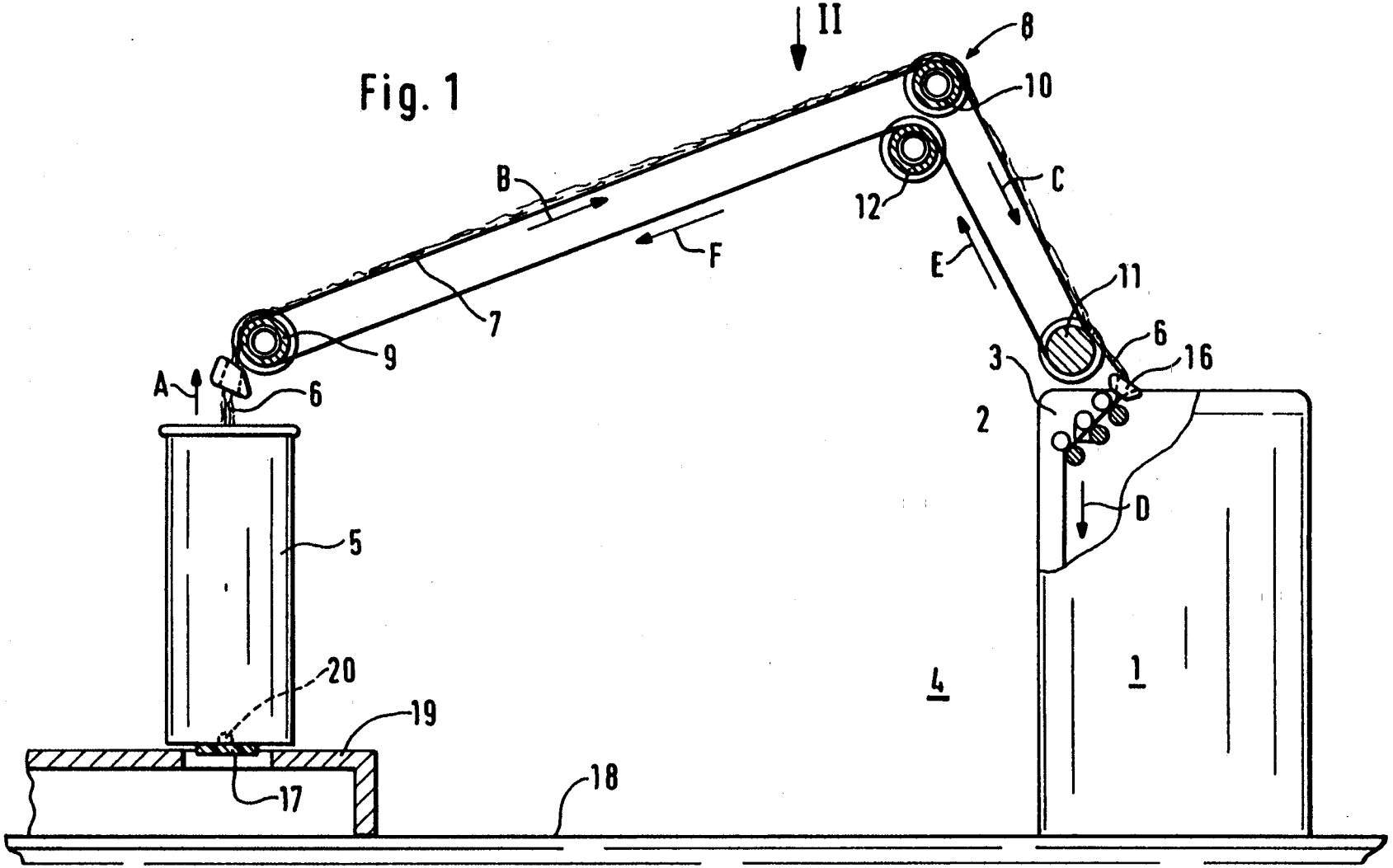
FIG. 1 is a partial cross-sectional view of a machine system comprising a spinning machine to the spinning stations of which one sliver respectively is fed by means of a can, the slivers being transported from the cans to the spinning stations by means of transport belts, constructed according to a preferred embodiment of the invention.

The spinning machine 1 shown in FIG. 1, which may, for example, be a ring spinning machine, is outlined only schematically. On both sides of the machine, it has a plurality of spinning stations 2 arranged next to one another of which only one drafting unit respectively is shown which is constructed as a three-cylinder drafting unit. An operating aisle 4 for the operating personnel is situated in front of the spinning stations 2. On the side opposite the operating aisle 4, cans 5 are deposited which contain the fiber material which is spun by the spinning stations 2.

Since the diameter of the cans 5 is larger than the spacing between two adjacent spinning stations 2, the cans 5 are arranged in several rows next to one another in a manner that is not shown.

The fiber material is fed to the spinning stations 2 as a sliver 6 produced on a drafting frame. The slivers 6 have a size of approximately Nm 0.3 to 0.8 so that they can be drafted to the desired yarn size by the three-cylinder drafting units 3 without any interference with their concentric running by drafting roller rotations that are too slow.

The relatively fine slivers 6 are transported from the cans 5 to the spinning stations 2 by means of transport belts 7 (see also FIG. 2) in such a manner that an unintentional draft is avoided during the transport.

The transport belts 7 are guided from an area above the cans 5 first diagonally upward over the operating aisle 4 to a deflecting guide 8 and from there, also in a sloped manner, to the spinning stations 2. The transport belts 7 each run over four deflecting rollers 9, 10, 11 and 12 which are each equipped with side rims 13 for the guiding of the transport belts 7. The deflecting rollers 9, 10, and 12 are rotatably arranged on tubes 14 extending in the longitudinal direction of the machine and are fixed in a manner that is not shown in the axial direction of the tubes 14. The deflecting rollers 11 are a component of a shaft 15 extending through in the longitudinal direction of the machine which is driven from the driving head of the spinning machine 1. The drive is selected such that the circumferential speed of the deflecting roller 11 is slightly lower than the feeding speed of the drafting unit 3. The deflecting rollers 9 situated above the cans 5 are constructed as tension rollers for the transport belts 7.

The slivers 6 are taken out of the cans 5 in the direction of the arrow A, are transported by the pertaining transport belt 7 in the direction of the arrow B to the upper deflecting guide 8 and from there, in the direction of the arrow C, farther to the spinning stations 2. By way of a feeding hopper 16, the slivers 6 then travel into the pertaining drafting unit 3, from where they are guided in the direction of the arrow D into a twist-providing element which is not shown and which may be a ring spinning machine.

The cans 5 are deposited on conveyer belts 17 extending in the longitudinal direction of the machine which are laid in a platform 19 arranged slightly above the floor 18. The conveyer belts 17 are equipped with button-type take-along devices 20 which grip behind the inner lower edge of the normally slightly elevated bottoms of the cans 5 and thus take along the cans with a certain form closure, transport them and hold them in the desired position. When the conveyer belts 17 are stopped, the cans 5 are therefore automatically in the correct position in which they remain during the spinning operation. The slope of the first rising and then lowering transport belt 7 with respect to the horizontal line is such that the slivers 6 lie on the transport belts 7 only by their own weight and are transported in this manner. In this case, the slope must be selected such that, also when the transport belts 7 are stopped, the slivers 6 do not slide off as a result of gravity. In especially preferred embodiments, the slope of the transport belts is below 60°. Thus, when the slope is correct, it is possible to do without elements that press the slivers 6 onto the transport belts.

Figure 2:
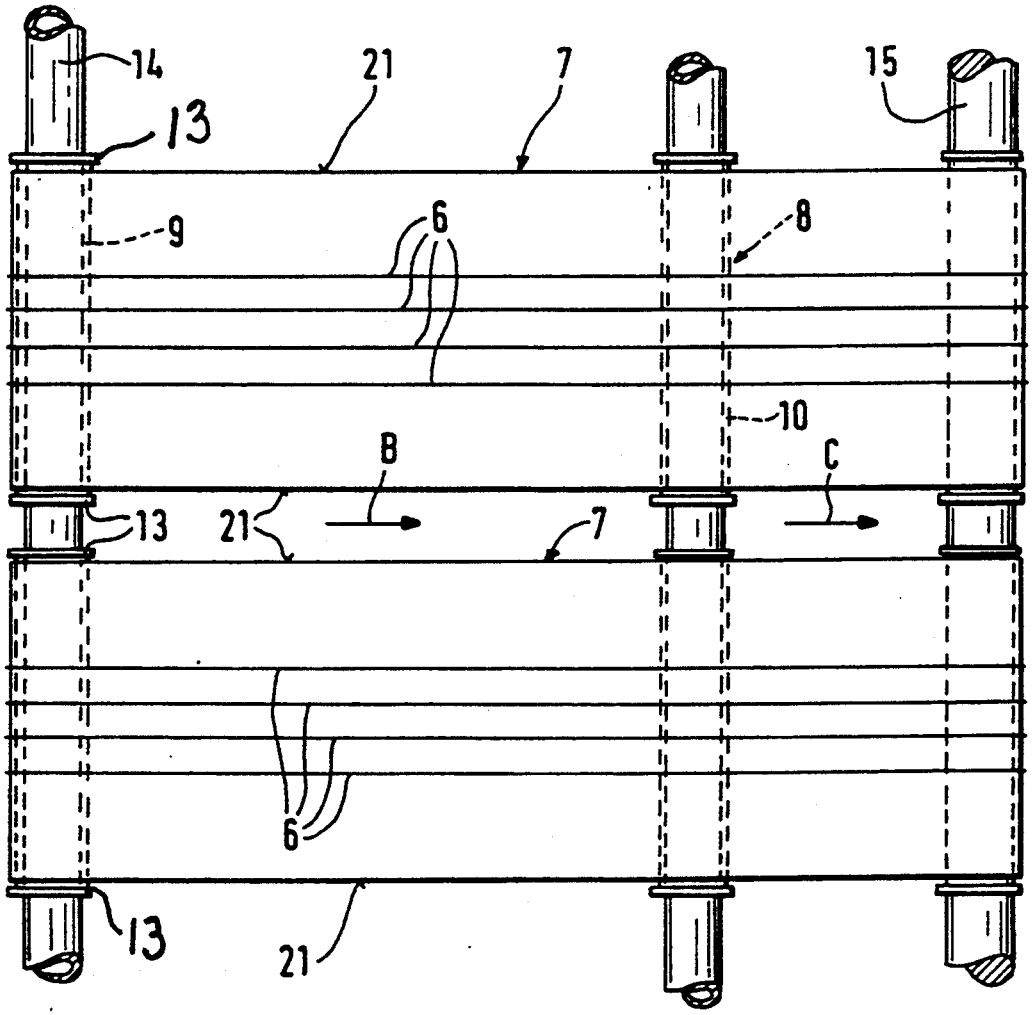
FIG. 2 is a view of two transport belts, taken in the direction of the arrow II of FIG. 1.

Particularly because of unavoidable air movements, there is the danger that the slivers 6 are deflected laterally on the transport belts 7 during the transport. So that the slivers 6 do not neverless leave the transport belts 7 they are constructed to be very wide as shown in FIG. 2. In this case, it is expedient for the lateral edge 21 of the transport belts 7 to have a sufficiently large distance from the transported slivers 6, so that the slivers 6 can definitely not fall off the transport belts 7. In the case of a sufficiently large distance of the edges 21 from the slivers 6, there is the additional advantage that the accumulation of fiber fly is minimized at the edges 21.

As also indicated in FIG. 2, several slivers 6 can advantageously be transported by means of one transport belt 7. Deviating from the representation of FIG. 2, eight or even sixteen slivers 6 can be transported by means of one transport belt 7.

In a development according to FIGS. 1 and 2, it is expedient to be careful when mounting so-called travelling cleaners on the spinning machine 1 so that they definitely do not blow on any the slivers 6. This may be implemented by means of corresponding shields which are not shown.

Figure 3:
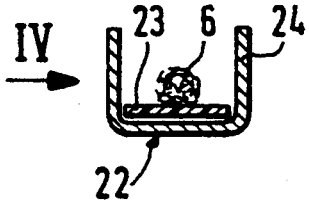
FIG. 3 is a cross-sectional view of a transport belt with a protective U-shaped covering, constructed according to a preferred embodiment of the invention.

According to the embodiment of FIG. 3, a separate transport belt 23 is provided for each sliver 6. This belt 23 is guided in a U-shaped rail 22, the lateral flanges 24 of which are sufficiently high. As a result, the sliver 6 is prevented from falling laterally off the transport belt 23, and, in addition, the slivers 6 are protected against damaging lateral air flows.

Figure 4:
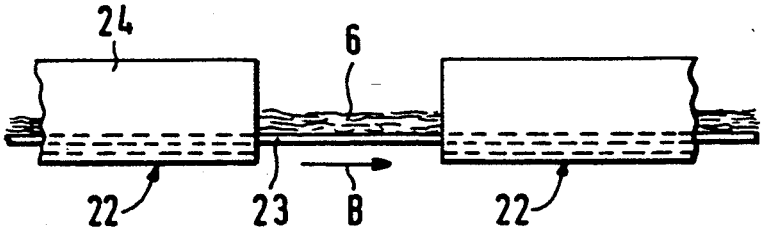
FIG. 4 is a view in the direction of the arrow IV of FIG. 3.

The rails 22 do not have to be continuous. According to FIG. 4, it is sufficient for such a rail 22 to be present at useful distances. It does not matter that the slivers 6 are laterally unguided in-between.

Figure 5:
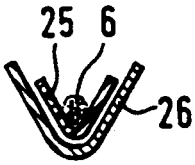
FIG. 5 is a cross-sectional view similar to FIG. 3 with a transport belt that is guided in a V-shape, in accordance with another preferred embodiment of the invention.

In the embodiment according to FIG. 5, a very flexible transport belt 25 is guided in a V-shape, the transport belt 25 adapting itself to a correspondingly shaped sheet metal guide 26. The V-shaped cross-section may exist at some points in a more or less pronounced manner so that the transport belt 25 becomes flat again between two sheet metal guides 26 and therefore travels normally. In areas where there is a sheet metal guide 26, the sliver 6 will be centered, whereby it is ensured that the slivers 6 remain in the center on the transport belts 25 and cannot slide off laterally.

Figure 6:
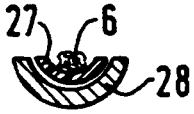
FIG. 6 is a cross-sectional view similar to FIG. 5 with a transport belt that is slightly bulged out in the downward direction, constructed according to another preferred embodiment of the invention.

According to FIG. 6, it is provided that the transport belt 27 is only slightly bulged out in the downward direction. The transport belt 27 runs in a type of gutter 28 and in the process assumes its shape. The desired centering effect is obtained again, and the sliver 6 is, in addition, protected against lateral air by means of the covering.

Figure 7:
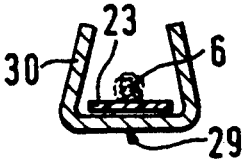
FIG. 7 is a cross-sectional view similar to FIG. 3, the protective covering being narrowed above the transport belt, constructed according to another preferred embodiment of the invention.

In FIG. 7, a rail is provided again which covers the transport belt 23 and the cross-section of which is approximately U-shaped, in which case the lateral flanges 30 are bent away in such a manner, however, that the rail 29 narrows slightly above the sliver 6. As a result of this type of guiding, it is certain that the sliver 6 remains in the center on the transport belt 23.

Figure 8:
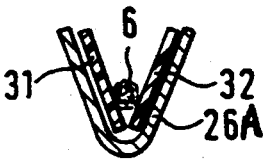
FIG. 8 is a cross-sectional view similar to FIG. 5, two flat transport belts being guided in a V-shape, constructed according to another preferred embodiment of the invention.

According to FIG. 8, a V-shaped sheet metal guide 26A is provided again in which, however, two transport belts 31 and 32 are guided in such a manner that together they form a type of "V" in which the sliver 6 travels.

Figure 9:
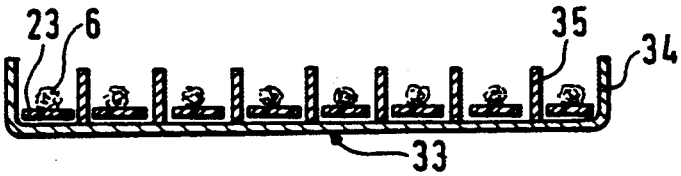
FIG. 9 is a view of eight transport belts arranged next to one another, to which a joint covering is assigned which has partitions, constructed according to another preferred embodiment of the invention.

In the embodiment according to FIG. 9, a total of eight transport belts 23 are provided which each transport one sliver 6 and to which a common wide U-shaped rail 33 is assigned. In addition to the flanges 34, partitions 35 are in each case arranged between two transport belts 23 so that each sliver 6 is protected from a lateral sliding-off from the pertaining transport belt 23 and is protected against lateral air. The partitions 35 are sufficiently high. In this case, it is sufficient for the rails 33 to be present only intermittently. In particular, the rails 33 will be mounted where there is the danger of a lateral travelling-away of the slivers 6, for example, because a travelling cleaner moves past there.

Figure 10:
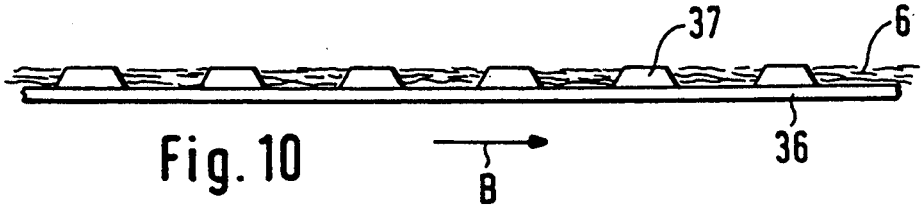
FIG. 10 is a lateral view of a transport belt which is provided with lateral protective walls, constructed according to another preferred embodiment of the invention.

In the embodiment according to FIG. 10, a transport belt 36 is provided which at certain distances has lateral wall sections 37 which are mounted on it. This also prevents a lateral sliding -off of the slivers 6 from the pertaining transport belt 36. The wall sections 37 may be so low and so short that the transport belt 36 can be guided perfectly around the deflecting rollers 9, 10, 11 and 12.

Figure 11:
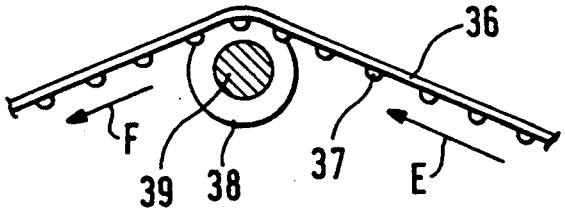
FIG. 11 is a view of the transport belt according to FIG. 10 in the area of a deflecting roller.
Figure 12:
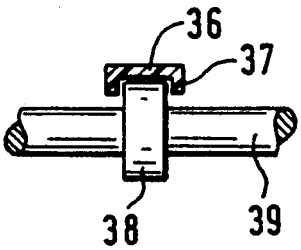
FIG. 12 is a cross-sectional view of the transport belt according to FIG. 11 in the area of a deflecting roller.

According to FIGS. 11 and 12, a deflecting roller 38 is provided instead of the deflecting roller 12 according to FIG. 1. This deflecting roller 38 is mounted on a continuous rod 39 so that it is freely rotatable but axially fixed. In this case, the wall sections 37 of the transport belt 36 receive the deflecting roller 38 between one another and form a lateral guide for the transport belt 36 on the run which returns corresponding to the direction of the arrows E and F. In the areas in which the sliver 6 is guided, the wall sections 37, however, form a lateral guide for the sliver 6.

Figure 13:
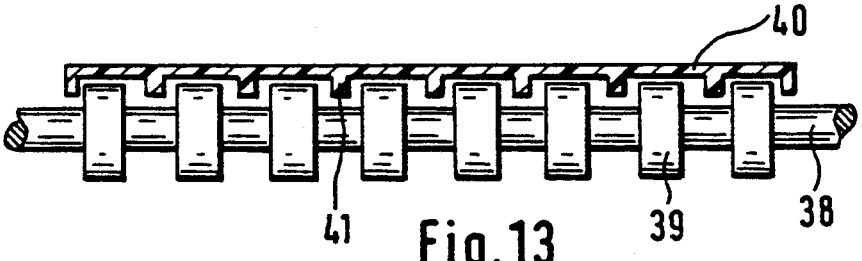
FIG. 13 is a view of the arrangement of deflecting rollers for an extremely wide transport belt, constructed according to another preferred embodiment of the invention.

According to FIG. 13, a very wide transport belt 40 is provided with respective intermediate webs 41 which on the transport path laterally cover and guide, for example, eight slivers 6 and which, however, in turn, are guided by correspondingly constructed deflecting rollers 39 arranged on a rod 38. Such transport belts 40 can be produced at very reasonable cost in a series production.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine comprising:

a plurality of spinning stations for the spinning of slivers into yarns, the spinning stations having drafting units, sliver supply cans, with an operating aisle arranged between the sliver supply cans and the spinning stations, drivable transport belts positioned between the cans and the spinning stations for conveying the slivers between the cans and the spinning stations, wherein the transport belts have a first section which extends from the area of the cans at least one of horizontally and ascending to a deflecting point, and a second section which extends from the deflecting point diagonally downward to the drafting units of the spinning machine such that the transport belts bridge the operating aisle in a roof-type manner, and wherein the slivers rest loosely on the transport belts and are unclamped and unpressed on the transport belts, and further comprising means for preventing the slivers from leaving the transport belts in a lateral direction during transport of the slivers.

2. A spinning machine according to claim 1, wherein a width of the transport belts accommodates several slivers arranged next to one another.

3. A spinning machine according to claim 1, wherein a larger distance is left between the slivers and the edges of the transport belts than the distance between respective slivers on the transport belts.

4. A spinning machine according to claim 1, wherein the means for preventing include at least partially lateral coverings assigned to the transport belts.

5. A spinning machine according to claim 1, wherein the transport belts have a trough-shaped cross-section at least on one portion of their transport path, lateral edges of the trough-shaped cross-section serving as the lateral protection devices.

6. A spinning machine according to claim 2, wherein the width of the transport belts accommodates simultaneous transportation of at least four slivers side-by-side.

7. A spinning machine according to claim 1, wherein the transport belts travel in U-shaped supports with sides of the U-shaped supports providing protection against lateral disturbances of the sliver being transported.

8. A spinning machine according to claim 7, wherein each sliver is transported on a separate transport belt.

9. A spinning machine according to claim 1, wherein the sliver supply cans are elevated such that the first section of the transport belts extends from the areas of the cans horizontally to the deflecting point.

10. A spinning machine according to claim 1, wherein the means for preventing the slivers from leaving the transport belts includes transport belts having a width that prevents the slivers from leaving the transport belts.

11. A spinning machine according to claim 1, wherein the first and second sections are inclined at respective inclination angles of less than 60°.

12. A spinning machine according to claim 1, wherein the first and second sections of the transport belts are inclined with respect to a horizontal line such that the slivers are stationary relative to the transport belts due to the weight of the slivers on the transport belts.

13. A spinning machine according to claim 12, wherein the first and second sections are inclined at an inclination angle of less than 60°.

14. A Spinning machine according to claim 1, wherein the first and second sections of the transport belts are provided on respective endless belts which travel over both said first and second sections.

15. A spinning machine according to claim 14, wherein belt deflection rollers are provided at belt turn around locations adjacent the beginning of the first section above the area of the cans and the end of the second section adjacent an inlet to the drafting units.

* * * * *